United States Patent [19]

Gohlke

[11] Patent Number: 5,042,676

[45] Date of Patent: Aug. 27, 1991

[54] HANDLE MOUNTING FOR CONTAINERS

[75] Inventor: Gerhardt Gohlke, Sinsheim, Fed. Rep. of Germany

[73] Assignee: Mauser-Werke GmbH, Bruhl, Fed. Rep. of Germany

[21] Appl. No.: 567,883

[22] Filed: Aug. 15, 1990

[30] Foreign Application Priority Data

Aug. 19, 1989 [EP] European Pat. Off. ..... 89115355.3

[51] Int. Cl.[5] ..... B65D 25/00

[52] U.S. Cl. ..... 220/94 R

[58] Field of Search ..... 220/94 R, 85 H, 91

[56] References Cited

U.S. PATENT DOCUMENTS

| | | | |
|---|---|---|---|
| 3,278,216 | 10/1966 | Hidding | 220/94 R |
| 3,297,351 | 1/1967 | Hidding | 294/33 |
| 3,412,887 | 11/1968 | Swartwood et al. | 220/94 R |
| 4,351,448 | 9/1982 | Ingersoll et al. | 220/318 |
| 4,399,926 | 8/1983 | Eidels-Dubovoy | 220/94 R X |
| 4,673,625 | 6/1987 | McCartney et al. | 220/94 R X |
| 4,896,415 | 1/1990 | Bock | 220/94 R X |

FOREIGN PATENT DOCUMENTS

| | | |
|---|---|---|
| 1586110 | 3/1981 | United Kingdom . |
| ·2211162A | 6/1989 | United Kingdom . |

*Primary Examiner*—Steven M. Pollard

*Attorney, Agent, or Firm*—Pennie & Edmonds

[57] ABSTRACT

A handle mounting for a container in which a bracket plate, removably fastened on the container circumference and made spreadably by at least one dividing slit, has an undercut formed in a projection around the periphery of its inner side, which in the installed state matingly engages a mushroom-like projection formed from the material of the container.

20 Claims, 3 Drawing Sheets

HANDLE MOUNTING FOR CONTAINERS

BACKGROUND OF THE INVENTION invention relates to a mounting for handles on plastic containers, and more particularly to such a mounting in which a bracket plate bearing the handle is removably fastened to a protrusion on the container wall circumference.

Generally, in blow molded plastic containers having folding handles, the handles are secured to the container by means of bracket plates attached to the container circumference. Such bracket plates are pre-manufactured and laid by hand, in a preheated state, into the open blow mold in recesses provided for this purpose. After the blow mold halves have been closed around the extruded plastic preform, the blow molding of the container occurs and the container wall lays itself against the internal contour of the mold. The bracket plates weld themselves by their own heat to the outside of the inflated container. After the container is stripped out of the mold, the pre-manufactured handles are connected to the bracket plates.

This procedure has proved to be not entirely satisfactory. If, for example, the preheating temperature should be insufficient, no reliable welding of the bracket to the container will take place. In such a case the bracket plates can be torn out by rough improper handling. Additionally, the heating procedure is difficult, and, when the blow-mold is open, placing the bracket plates in the mold recesses provided therefor adds an additional step to the manufacturing process and is time-consuming.

It is therefore an object of the invention to create a secure fastening for handles on a plastic blow mold container which eliminates the welding and the handling of the bracketplate in the open blow mold, while also shortening the set-up time.

SUMMARY OF THE INVENTION

Accordingly, in the present invention the bracket plate is provided with at least one dividing slit and has an undercut formed on its back which matingly engages a mushroom-shaped projection formed from the wall circumference of the container.

This permits a mechanical fastening of the carrying handle on a container already shaped in the blow mold. The attachment is easily and quickly accomplished because the dividing slit or slits allow the bracket plate halves to be spread apart and thus the bracket plate can be pushed onto the container projection.

In one embodiment, the handle is mounted on a pivot in a support bracket integrally formed with the bracket plate. In this embodiment, a single dividing slit is provided in the bracket plate beginning at the upper edge of the bracket plate, dividing the bracket plate and the support bracket and terminating a bore near the bottom edge of the bracket plate. The bracket plate is spread open laterally, placed on the mushroom-like projection of the container, and squeezed together to lock onto it. The bracket is secured in this position by the handle which is set in place and held by a pivot pin. Since the handle is removable, the combination carrying handle can be removed in case of necessity.

In an alternative embodiment of the invention two dividing slits are provided in the bracket plate, situated side by side a fixed distance apart and forming a flap between them. They extend from the upper edge into the middle portion of the bracket plate. The handle and bracket plate are constructed with a hinge-like transition between them and are fastened to the container in a single operation.

In a preferred embodiment the carrying handle is provided with an upper abutment or stop, which blocks the handle in a position inclined about 20° to 40°, preferably around 35°, from the vertical.

This is important especially since the carrying handle is intended to be suitable for mounting on two opposite side walls of a large container (for example, a canister or drum with cubic contents of 100 L or more) and service personnel must be prevented from pinching their fingers or the back of the hand when a completely filled container provided with carrying handles pursuant to the invention is lifted by the handles and transported. In this connection, as an upper abutment of the carrying handle, a wedge-shaped projection may be provided on the outer surface of the carrying handle pointing upward as a stop against the bracket plate.

However, the upper abutment may alternatively be provided as a wedge-shaped projection arranged on the outer surface of the bracket plate as a stop against the carrying handle. A combination of these features is alternatively suitable.

At the same time, to prevent the carrying handles from falling obliquely away by themselves from the body of the drum when the handles are not in use, a releasable locking of the pivoted carrying handle is effected in a position tilted perpendicularly downward. For this purpose, a locking snap connection is formed between the lower bracket plate and the middle piece of the carrying handle.

DETAILED DESCRIPTION OF THE INVENTION

Figure 1:
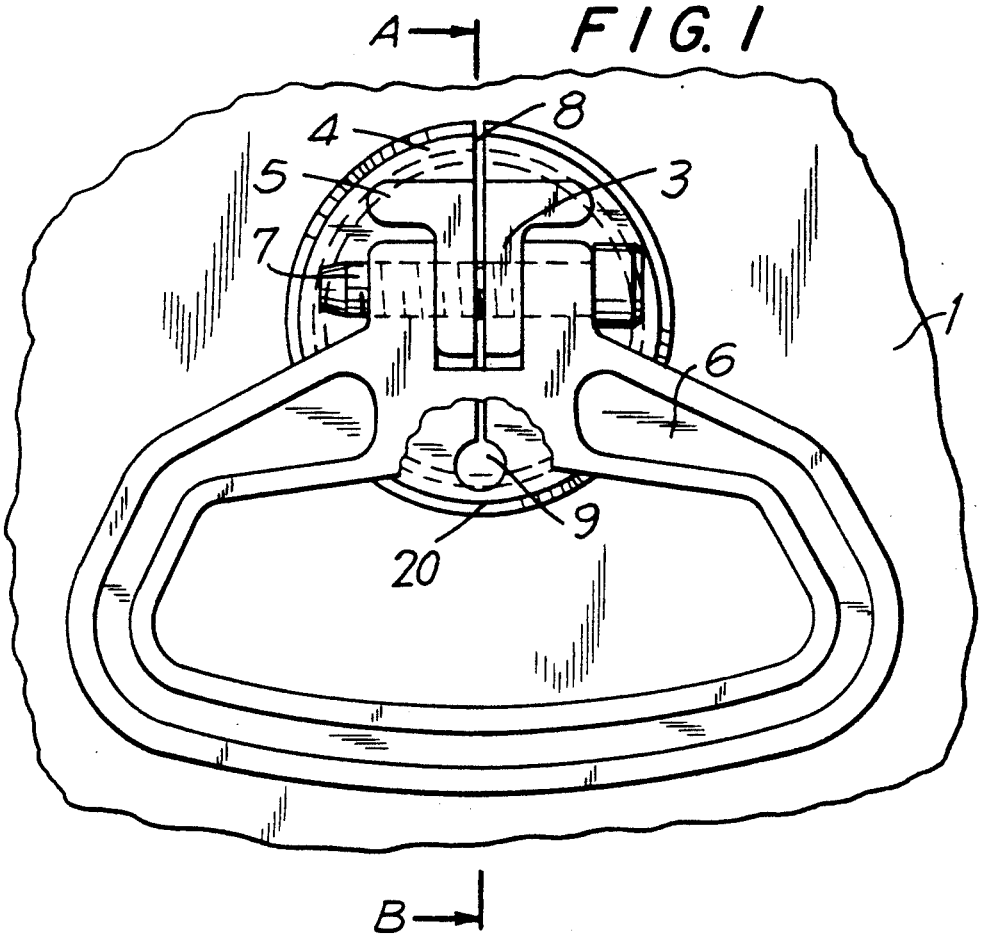
FIG. 1 is a front elevation of a carrying handle mounted on a pivot pin on the container circumference according to the present invention.

Referring to FIG. 1, a bracket plate 4 is provided with a dividing slit 8 beginning at the upper edge of the bracket plate 4. The slit 8 also divides a support bracket 3 projecting from the outer side of the bracket plate 4 and then leads into a bore 9 forming the end of slit 8. A bridge of material 20 between the bore 9 at the end of slit 8 and the edge of the bracket plate 4 acts as a hinge in the spreading of the bracket plate 4.

The bracket plate 4 is also provided with an undercut 18 formed on its inner side. The undercut engages with the outer edge of a mushroom-like projection 2 formed from the material of the container 1 in a trough-like recess on the container wall circumference.

The bracket plate 8 is releasably fastened onto the container 1 by spreading the two halves of bracket plate 4 and pushing it over the projection 2 so that the undercut 18 engages the outer edge of the mushroom-like projection 2.

After the bracket plate 4 has been snapped into place, a carrying handle 6 is placed on the support bracket 3 and affixed by a pivot pin 7 force-fitted through the pivot bores in the bracket. In this manner the bracket plate 4 is also held in firm engagement with the container projection 2. Outer ends 5 of the pivot support bracket 3 form an abutment for the carrying handle 6, so that, when a filled container is being transported, the handle will, as shown in FIG. 2, be held at a fixed distance from the circumference of the container.

Figure 2:
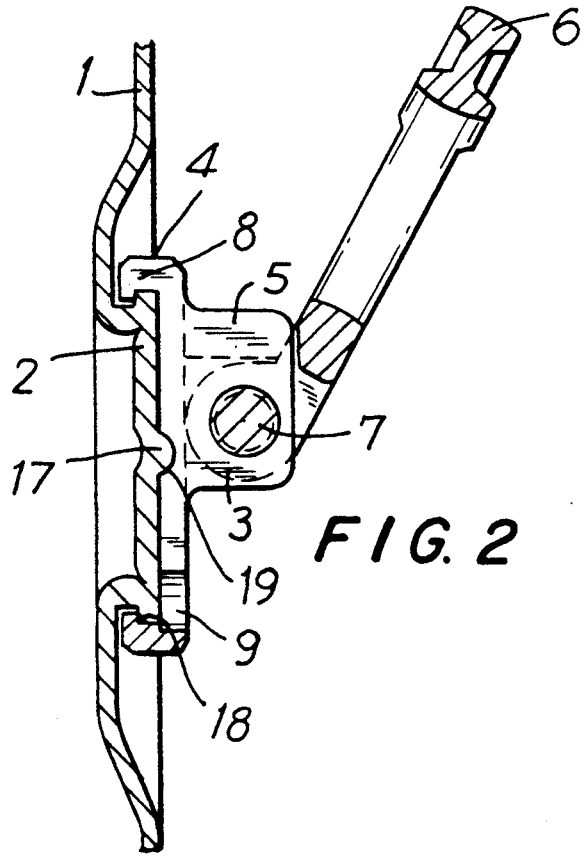
FIG. 2 is a cross section along line A—B of FIG. 1 with the handle raised up.

As shown in FIG. 2, a horizontally extending rib 17 protrudes from the outer part of the container projection 2 and engages in a mating indentation 19 on the inner side of the installed bracket plate 4. This holds the plate from turning and assures that the handle will remain properly positioned during lifting of the container.

Figure 3:
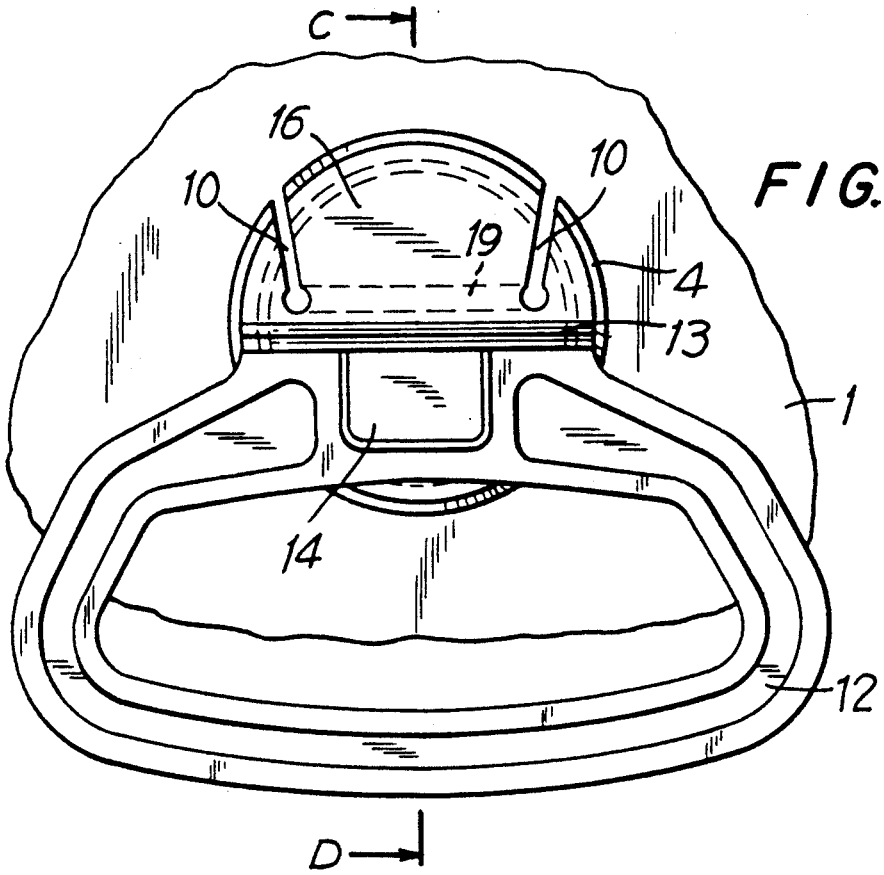
FIG. 3 is a front elevation of an alternate embodiment of the present invention with a carrying handle hinged to the bracket plate.
Figure 4:
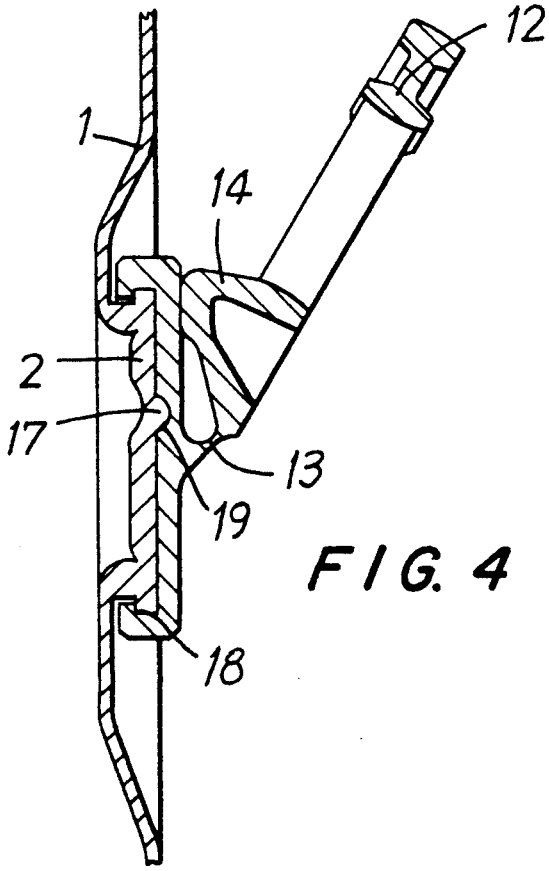
FIG. 4 is a cross section along line C—D of FIG. 3 with the handle raised up.

In the embodiment according to FIGS. 3 and 4, two dividing slits 10 lying at a fixed distance apart lead from the upper edge of the bracket plate 4 into the middle part of the plate and form between them a flap 16. The bottom ends of the dividing slits 10 are joined together by the groove 19 that accommodates the rib 17 (indicated in broken lines in FIG. 3), so that the flap 16 can easily be turned back out of the plane of the drawing. This also prevents rotation of the handle on the container.

The space between the upper openings of the slits is selected such that, when the bracket plate 4 is pushed upward onto the outer margin of the projection 2, the circular undercut 18 will bias against and grip the projection 2 circumference. The distance between the slits 10 at the beginning of each slit along the upper edge of the bracket plate 4 is therefore slightly narrower than the outer diameter of the projection 2 and the circular undercut 18 on the bottom of the bracket plate 4.

Beneath the ends of the slits, the bracket plate 4 merges at a hinge-like transition 13 with a carrying handle 12, whose upward movement is limited by an abutment 14 on the handle engaging the upper side of the flap which acts as an opposing abutment.

To attach the handle to the container, the bracket plate 4 is placed against the bottom of the projection 2 of the container and pushed upward. The flap 16 bends easily back and does not mate fully with the projection 2 until the plate has been pushed all the way up and the flap snapped down over the projection 2. The undercut 18 engages the outer edge of the projection 2 with a slight bias. In addition to the saving of time, in this embodiment, a saving of weight and material is also obtained.

Figure 5:
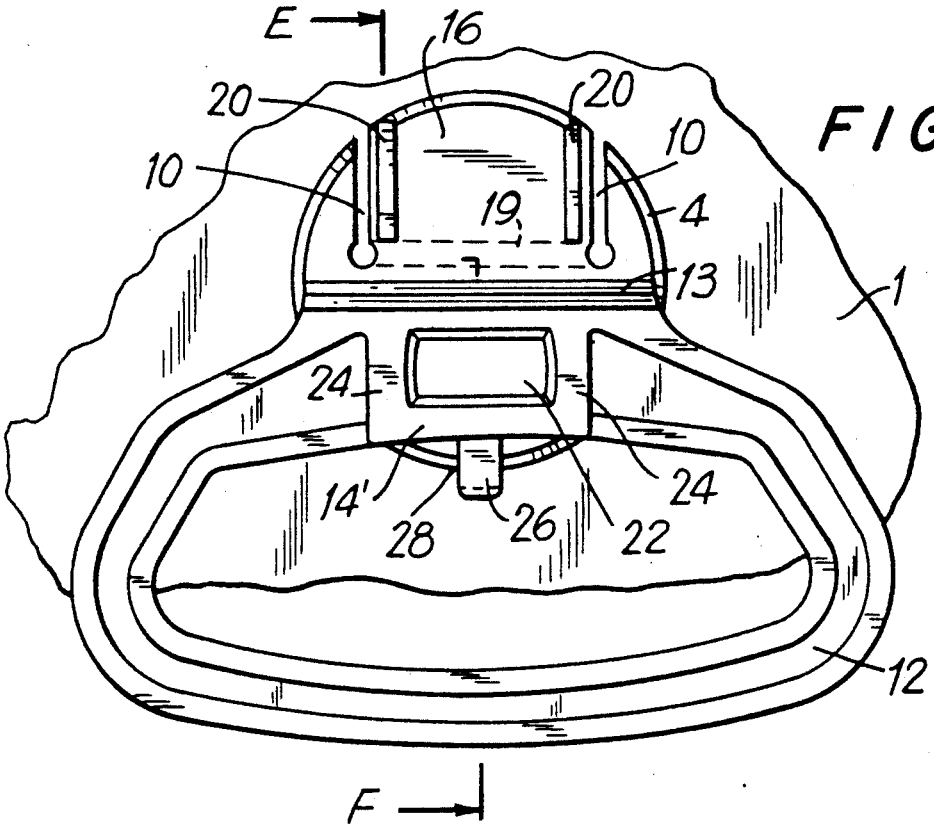
FIG. 5 is a front elevation of another embodiment of the carrying handle pursuant to the invention.

In the example shown in FIG. 5, a specially designed upper abutment is provided. On the outer surface of the flap 16 of the bracket plate 4 two wedge-shaped ribs 20, parallel to one another, are formed near the dividing slits 10. These ribs act as projecting abutments against the raised carrying handle 12.

Figure 6:
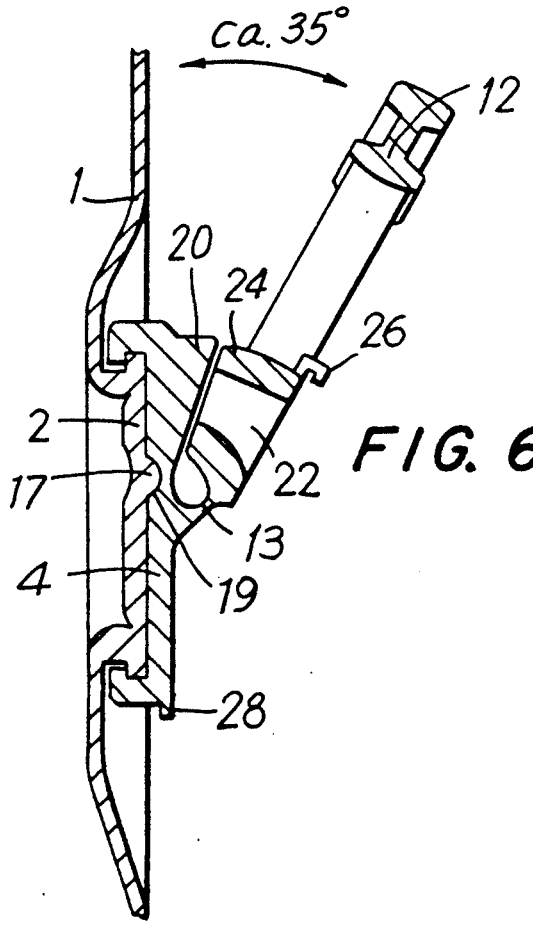
FIG. 6 is a cross-section along lines E—F of FIG. 5 with the handle raised up.

As can be seen better in FIG. 6, the middle piece 14', in which an indentation 22 or a window is worked to save material, is alternatively provided on the outer surface of the carrying handle 12 with a wedge-shaped abutment 24. This engages against the wedge-shaped abutment 20 on the flap 16 of the bracket plate 4; and the carrying handle 12 is thus blocked in its inclined position about 25° to 40°, preferably about 35°, from the vertical. In this way a clearance is maintained between container wall 1 and carrying handle 12, so that service personnel do not pinch their fingers when carrying a heavy container.

In addition, the carrying handle 12 pursuant to the invention is provided in the center of the middle piece 14' with a small elastic snap hook 26. This hook cooperates with a small locking nose 28 on the lower edge of the bracket plate. This locking snap connection is suitable for all embodiments of the invention and allows releasable locking of the carrying handle 12 in a position tilted perpendicularly downward (FIG. 5), so that the carrying handle cannot fall away in an uncontrolled position by itself. In this position, tight packing or tight assembly of the drums in storage or transport is facilitated.

What is claimed is:

1. A mounting for a container lifting handle for containers to be lifted, said container having a mushroom-like projection on the container wall, said mounting comprising a) a bracket plate having (i) inner and outer sides and an outer edge surrounding and defining the outer periphery of the plate, said outer edge being divided into an upper part generally facing in the direction of lifting of the container and a lower part facing in a direction other than the direction of lifting of the container, (ii) engaging means on the inner side of the bracket plate for matingly engaging with the projection of the container so as to removably fasten the plate onto the projection, and (iii) at least one dividing slit extending through the plate, each of said slits extending only from the upper part of the outer edge and along a direction extending in the direction of lifting of the container, said slits dividing the plate into at least two portions which can be spread apart relative to each other on opposite sides of said slit for fastening the plate onto the projection of the container, and b) a handle attached to said bracket plate on the outer side thereof for lifting the container.

2. The handle mounting for containers according to claim 1, wherein:

a) said engaging means includes a projection formed around the periphery of the plate and extending from the inner side of the plate, said projection defining a radially inwardly facing undercut adapted to engage with said mushroom-like projection.

3. The handle mounting for containers according to claim 1, wherein:

a) said slit extends from one end at one edge of the bracket plate to a second end at a location near an opposite edge of the bracket plate, said slit dividing the bracket plate into two portions and defining a resilient bridge hinge of material between the second end of the slit and the opposite edge of the plate.

4. The handle mounting for containers according to claim 1, wherein:

a) said bracket plate further includes a support bracket on the outer side thereof, said support bracket being split in two by said slit and having a bore extending therethrough from one side of the slit to the other; and b) said mounting further includes a pivot pin extending through said bore for pivotally connecting said handle to the support bracket.

5. The handle mounting for containers having a mushroom-like projection with a central raised rib extending thereacross according to claim 1, wherein:

a) said bracket plate includes a recess extending across its inner side, said recess being complementary in shape to said rib for receiving the rib when said bracket plate is fastened onto said mushroom-like projection.

6. The handle mounting for containers having a mushroom-like projection with a central raised rib extending thereacross according to claim 5, wherein:

a) said bracket plate includes a recess extending across its inner side, said recess being complementary in shape to said rib for receiving the rib when said bracket plate is fastened onto said mushroom-like projection; and b) the recess on the bracket plate extends between the ends of two slits forming a reduced thickness along the recess to facilitate pivoting of the flap along the recess.

7. The handle mounting for containers according to either one of claims 1 or 5 further including a) an abutment on said bracket plate; and b) an abutment on said handle for engaging the abutment on the bracket plate and limiting pivoting of said handle to an angular position spaced from the container wall during lifting of the container by the handle.

8. The handle mounting for containers according to claim 7, wherein:

a) the abutments are positioned for engagement with each other with the handle at an angular position of between about 25° to 40°.

9. The handle mounting for containers according to claim 5 further including:

a) an abutment on said bracket plate;

b) an abutment on said handle for engaging the abutment on the bracket plate and limiting pivoting of said handle to an angular position spaced from the container wall during lifting of the container by the handle; and c) the abutment on the bracket plate is formed on said flap and is wedge shaped with the thickest part located adjacent the edge of the plate.

10. The handle mounting for containers according to either one of claims 1 and 5 further including:

a) cooperating locking snap means on said handle and bracket plate for releasably locking said handle to said plate in a position lying against the container wall.

11. A handle mounting for containers having a mushroom-like projection on the container wall, said mounting comprising a) a bracket plate having:

(i) inner and outer sides, (ii) engaging means on the inner side of the bracket plate for matingly engaging with the projection of the container so as to removably fasten the plate onto the projection, and (iii) two dividing slits, each extending through the plate from one end at an edge of the plate to a second end spaced from said edge to divide the plate into at least two portions which can be spread apart relative to each other on opposite side of said slits for fastening the plate onto the projection of the container, said slits being spaced a distance apart from each other at both the one ends and the second ends thereof and extending in generally the same direction from said edge of the plate along a direction extending approximately in the direction of lifting and ending at the second ends thereof approximately in the middle of the plate, with said slits defining between them a flap capable of being displace to facilitate fastening of the bracket plate onto the mushroom-like projection of the container; and b) a handle, independent of the flap, attached to said bracket plate on the outer side thereof and extending in a direction generally crosswise of the direction of said slits.

12. The handle mounting for containers according to claim 11, wherein:

a) said bracket plate includes a thin hinge-like transition part integrally formed on its outer side, said transition part being disposed beyond the ends of the slits; and b) said handle is integrally formed with said transition part and the bracket plate.

13. The handle mounting for containers according to claim 11, wherein:

a) the bracket plate is circular in shape with the projection on the inner side being circular and defining an annular inward facing undercut; and b) the distance between said two slits at the edge of the bracket plate is slightly narrower than the diameter of the annular undercut.

14. A container comprising:

a) a side wall, top and bottom;

b) a single mushroom-like projection extending outwardly from the wall;

c) a bracket plate for mounting a container lifting handle on the side wall of the container to be lifted, said bracket plate having inner and outer sides and an outer edge surrounding and defining the outer periphery of the plate, said outer edge being divided into an upper part generally facing in the direction of lifting of the container and a lower part facing in a direction other than the direction of lifting of the container, said plate further including:

(i) a projection formed around the periphery of the plate and extending from the inner side of the plate, said projection defining a radially inward facing undercut adapted to engage said mushroom-like projection so as to removably fasten the plate onto the projection, and (ii) at least one dividing slit extending through the plate, each of said slits extending only from the upper part of said outer edge and along a direction extending in the direction of lifting of the container, said slits dividing the plate into at least two portions which can be spread apart relative to each other on opposite sides of said slit for fastening the plate onto the projection of the container; and d) a handle attached to said bracket plate on the outer side thereof for lifting said container.

15. The container according to claim 14, wherein:

a) said slit extends from one end at one edge of the plate to a second end at a location near an opposite edge of the bracket plate, said slit dividing the bracket plate into two portions and defining a resilient bridge hinge of material between the second end of the slit and the opposite edge of the plate.

16. The container according to claim 15, wherein:

a) said bracket plate further includes a support bracket on the outer side thereof, said support bracket being split in two by said slit and having a bore extending therethrough from one side of the slit to the other; and b) said mounting further includes a pivot pin extending through said bore for pivotally connecting said handle to the support bracket.

17. A container comprising:

a) a side wall, top and bottom;

b) a mushroom-like projection extending outwardly from the wall;

c) a bracket plate having inner and outer sides with said bracket plate including;

(i) a projection formed around the periphery of the plate and extending from the inner side of the plate, said projection defining a radially inward facing undercut adapted to engage said mushroom-like projection so as to removably fasten the plate onto the projection, and (ii) two dividing slits, each extending through the plate from one end at an edge of the plate to a second end spaced from said edge to divide the plate into at least two portions which can be spread apart relative to each other on opposite sides of said slits for fastening the plate onto the projection of the container, said slits being spaced a distance apart from each other at both the one ends and the second ends thereof and extending in generally the same direction from said edge of the plate along a direction extending approximately in the direction of lifting and ending at the second ends thereof approximately in the middle of the plate, with said slits defining between them a flap capable of being displace to facilitate fastening of the bracket plate onto the mushroom-like projection of the container; and d) a handle, independent of said flap, attached to said bracket plate on the outerside thereof and extending in a direction generally crosswise of the direction of said slits.

18. The container according to claim 17, wherein:

a) said bracket plate includes a thin hinge-like transition part integrally formed on its outer side, said transition part being disposed beyond the ends of the slits;

b) said handle is integrally formed with said transition part and the bracket plate;

c) the bracket plate is circular in shape with the projection on the inner side being circular and defining an annular inward facing undercut;

d) the distance between said two slits at the edge of the bracket plate is slightly narrower than the diameter of the annular undercut; and e) the two slits extend from an edge on one side of a diameter through said plate and toward spaced points on said diameter.

19. The container according to either one of claims 16 and 18, wherein:

a) the mushroom-like projection includes a central raised rib extending thereacross; and b) said bracket plate includes a recess extending across its inner side, said recess being complementary in shape to said rib for receiving the rib when said bracket plate is fastened onto said mushroom-like projection.

20. The container according to either one of claims 16 and 18, wherein:

a) an abutment on said bracket plate; and b) an abutment on said handle for engaging the abutment on the bracket plate and limiting pivoting of said handle to an angular position spaced from the container wall during lifting of the container by the handle.

* * * * *